United States Patent [19]

Ballarin et al.

[11] 4,006,601

[45] Feb. 8, 1977

[54] REFRIGERATING DEVICE

[75] Inventors: Jürgen Ballarin; Peter Mattig, both of Giengen, Germany

[73] Assignee: Bosch-Siemens Hausgerate GmbH, Munich, Germany

[22] Filed: Dec. 2, 1975

[21] Appl. No.: 636,944

[30] Foreign Application Priority Data

Dec. 13, 1974 Germany ..... 2458981

[52] U.S. Cl. ..... 62/80; 62/277; 62/426; 62/513

[51] Int. Cl.[2] ..... F25D 21/00; F25B 47/00; F25D 17/06; F25B 41/00

[58] Field of Search ..... 62/80, 277, 513, 82, 62/151, 407, 408, 409, 419, 428, 441, 447, 255, 257, 426, 427, 154–156

[56] References Cited

UNITED STATES PATENTS

| | | | |
|---|---|---|---|
| 2,332,730 | 10/1943 | Kucher | 62/427 |
| 2,907,180 | 10/1959 | Mann | 62/419 |
| 2,956,416 | 10/1960 | Taylor | 62/426 |
| 2,960,844 | 11/1960 | Quick | 62/408 |
| 3,050,956 | 8/1962 | Mann et al. | 62/419 |
| 3,119,240 | 1/1964 | Denery | 62/419 |
| 3,745,786 | 7/1973 | Laughlin et al. | 62/426 |

*Primary Examiner*—Lloyd L. King
*Attorney, Agent, or Firm*—Michael J. Striker

[57] ABSTRACT

A refrigerating device has a housing including at least one storage compartment. A cooling apparatus including an evaporator, a compressor and a condenser is accommodated in the base of the housing, the evaporator being surrounded by a casing of a thermally conductive material in good thermal contact with the evaporator. The casing separates a passage for circulating a stream of air to be cooled from an additional passage through which an additional stream of air is intermittently passed, after being conducted past or through the condenser or compressor of the cooling apparatus and being heated thereby, the heated additional stream of air defrosting the evaporator. The intermittent passage of the stream of hot air is controlled by deviating flap valves which may be insulated, the position of the flap valves being controlled in dependence on operating parameters of the cooling apparatus.

17 Claims, 3 Drawing Figures

REFRIGERATING DEVICE

BACKGROUND OF THE INVENTION

The present invention relates to a refrigerating device, and more particularly to a no-frost refrigerator, freezer or a combination refrigerator-freezer.

There are already known various constructions of refrigerating devices, such devices differing from one another mainly in the arrangement of the various components of the cooling apparatus. Such refrigerating devices include commercial or household refrigerators, freezers or combination refrigerator-freezers. The most recent development in the field of constructing refrigerating devices is the construction of so-called no-frost refrigerating devices in which formation of ice on the evaporator coils is to be kept to a minimum and such evaporator coils are to be periodically defrosted. Among the known and commercially available structurally different types of refrigerating devices, the present invention is concerned with such a refrigerating device in which the evaporator is located outside of the storage compartment of the refrigerating device, and the cooling of the interior of the storage compartment and of the contents thereof is accomplished by means of a stream of air which is deprived of some of its heat content in the evaporator, and which is forced to circulate through the evaporator and through the storage compartment.

There is already known a refrigerating device of a similar type in which the evaporator coil is periodically defrosted by means of an air stream which is withdrawn, during the standstill periods of the cooling device, from the storage compartment, and more particularly from a region thereof which is at a temperature above the freezing point, the stream of air being conducted over the heat-exchange surfaces of the evaporator, thus transmitting heat to the evaporator and defrosting the same. However, the available heat content of the air which is conducted through the evaporator in this manner is very minute, especially since the temperature of the air in the region from which it is withdrawn is only several degrees above the freezing temperature. In addition thereto, in many instances the volume of the air so conducted through the evaporator during the defrosting part of the cycle is very small. As a result of this, a very long time is needed for a complete defrosting of the evaporator. The time which would be necessary for completely defrosting the evaporator is in most instances longer than the standstill periods of the cooling apparatus, so that the evaporator is satisfactorily and completely defrosted only under the rarest circumstances. This, of course, brings about the danger that a layer of ice will gradually develop and grow on the evaporator. In addition thereto, this conventional arrangement requires complicated systems of regulating and control flaps or flap valves, and complex mechanisms are required for actuating such flap valves which are very expensive and prone to malfunction.

It has been already proposed, in order to expedite and accelerate the defrosting process in different conventional refrigerating devices of a similar type, to arrange a heating plate above the evaporator, the heating plate being heated with electric energy during the standstill times of the cycle of the cooling apparatus, the heating plate defrosting the evaporator coil in this manner. However, the energy consumption of the refrigerating device is considerably increased by using this electrical defrosting arrangement, so that the refrigerating device according to this proposal is substantially more expensive than other comparable devices in terms of construction costs and also in terms of the cost connected with operating the refrigerating device.

SUMMARY OF THE INVENTION

Accordingly, it is a general object of the present invention to avoid the disadvantages of the prior art refrigerating devices.

More particularly, it is an object of the present invention to provide a refrigerating device with a defrosting feature which is simple in construction and reliable in operation.

It is a concomitant object of the present invention to provide a refrigerating device with a defrosting arrangement which does not need any additional amount of energy for the operation thereof.

It is yet another object of the present invention to provide a no-frost refrigerating device in which the evaporator is defrosted even under most demanding ambient conditions.

In pursuance of these objectives and others, which will become apparent hereafter, one feature of the present invention resides, briefly stated, in a refrigerating device, in a housing which has at least one storage compartment, and a cooling apparatus which has a low temperature zone including at least one evaporator, and a high temperature zone including a condenser and a compressor. The device of the present invention further comprises an arrangement for circulating a stream of air through the low temperature zone to thereby cool the air passing through the low temperature zone, and also through the storage compartment, and an arrangement for passing an additional stream of air first through the high temperature zone and then through the low temperature zone separately of the first mentioned stream of air to thereby periodically defrost the evaporator.

According to a currently preferred embodiment of the present invention, the housing includes a base and the cooling apparatus is accommodated in the base. The circulated stream of air passing through the evaporator is forcibly advanced in its path. When the two streams of air are conducted in the manner proposed according to the present invention, it is possible to utilize the heat energy dissipated into the ambient atmosphere by the heat-producing parts of the cooling apparatus of the refrigerating device described in more detail above, such as the compressor and/or the condenser, for defrosting the evaporator. Inasmuch as this dissipated heat energy constitutes a loss of useful energy in the context of the refrigerating device, and since this lost energy results in an increase in the temperature of the air passing through the high temperature zone of the refrigerating device and must be conducted away from the high temperature zone with the stream of hot air to be transmitted to the ambient atmosphere, the partial utilization of the heat content of the stream of hot air is particularly advantageous. When the hot stream of air is used for defrosting the evaporator, this results in an especially quick, secure and inexpensive way of defrosting the evaporator.

According to one advantageous embodiment of the present invention, the evaporator is surrounded by a box-shaped casing which serves the purpose of separating the circulated stream of cold air from the stream of hot air which is intermittently passed through the low temperature zone in order to defrost the evaporator. More specifically, the casing serves the purpose of separating the passage for the cool air or air to be cooled from the passage for the warm air used for defrosting the evaporator. The casing is in good thermally conductive contact with the evaporator and is made of a material of high thermal conductivity so that rapid heat exchange will take place between the warm stream of air and the evaporator via the casing. The casing may be outwardly provided with means for bounding the passage for the warm or hot stream of air and for guiding the same, such as fins, which further increase the effectiveness of the heat transmission between the air used for defrosting the evaporator and the casing. When the evaporator is surrounded by a box-shaped casing as proposed by the present invention, it is especially simple to separate the cold air which is used for cooling the contents of the storage compartment from the stream of air which is used for defrosting the evaporator, and to thus create especially advantageous conditions for rapid and complete defrosting of the evaporator.

A further currently preferred advantageous feature of the present invention resides in the fact that deviating flap valves are used for controlling the amount and speed of the air stream used for defrosting the evaporator of the cooling apparatus, the position of the flap valves being dependent on the operating conditions of the cooling apparatus. The flap valves can be, to advantage, controlled either in dependence on the temperature of the condenser, or also in dependence on the compression pressure of the compressor.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
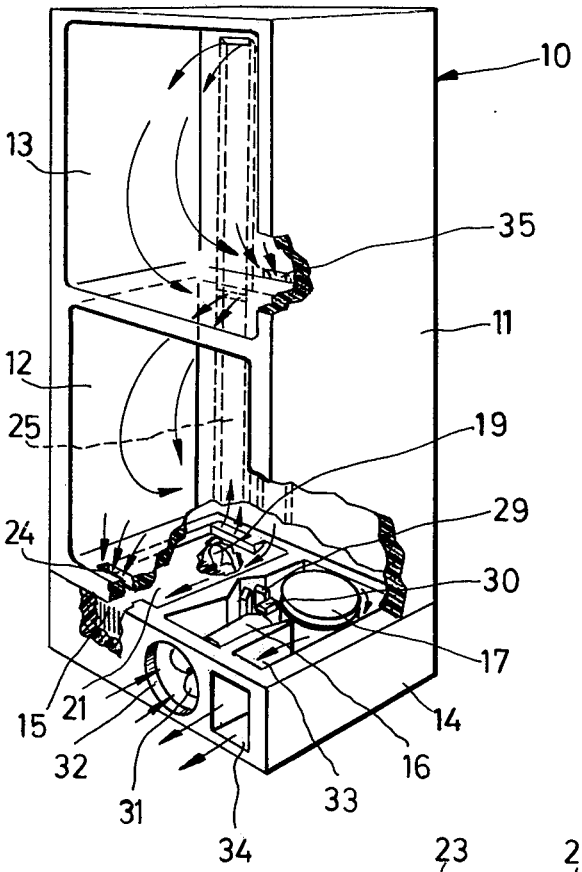
FIG. 1 is a perspective view of an example of the embodiment of the present invention in which parts of the walls have been broken away in order to show the interior of the refrigerating device.

Referring now to the drawing in detail, and first to FIG. 1 thereof, it may be seen that the refrigerating device has been designated in toto with a reference numeral 10. While the present invention has been illustrated and will be discussed in connection with one particular exemplary type of refrigerating device, it should be understood that it can be employed in other refrigerating devices, including but not limited to commercial or household refrigerators, freezers or combination refrigerator-freezers. The no-frost refrigerating device 10 has a thermally insulated housing 11, and is interiorly subdivided into two compartments arranged above one another, the lower compartment 12 being a freezer and the upper compartment 13 being a refrigerator. The housing 11 rests on base 14, and a cooling apparatus is accommodated in the base 14, the cooling apparatus essentially consisting of an evaporator 15, a condenser 16 and a hermetically closed compressor 17.

Figure 3:
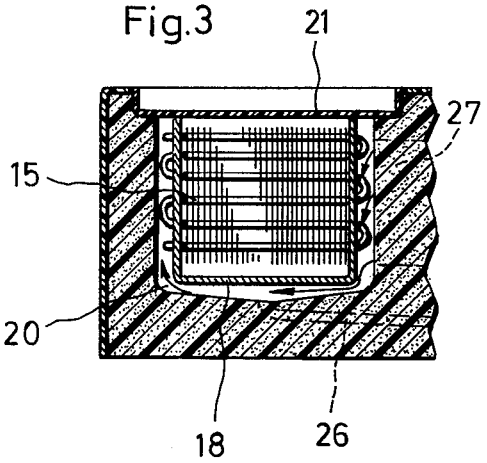
FIG. 3 is a cross-sectional view taken on line III—III at an even larger scale.
Figure 2:
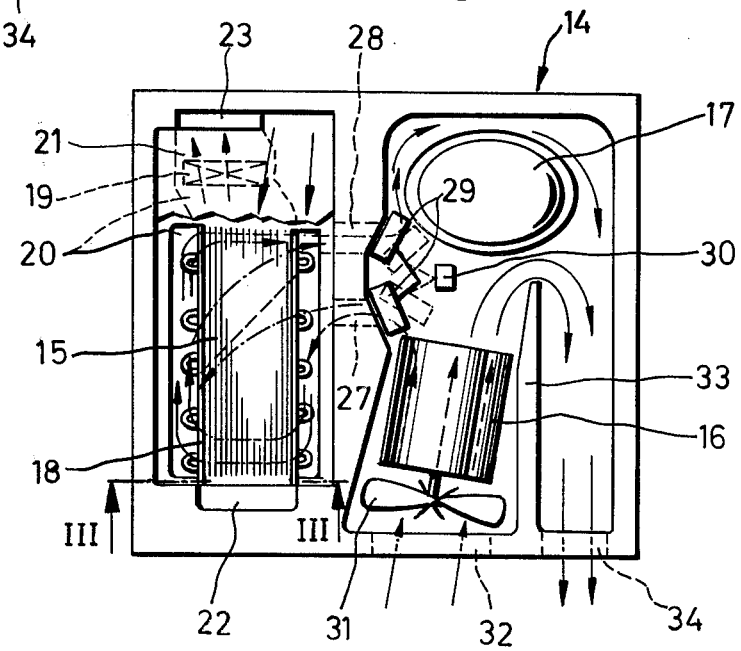
FIG. 2 is a simplified top plan view of the base of the refrigerating device of FIG. 1 on a larger scale.

In the illustrated embodiment of the present invention, the evaporator, as can be most easily ascertained from FIGS. 2 and 3, is constructed as a box-shaped evaporator which includes a plurality of lamellae or fins. Walls are arranged at the lateral portions of the evaporator 15 as well as at the bottom thereof, these walls extending over the entire length of the evaporator 15 and together constituting a casing 18 which is open at its both ends and also in the upward direction. The walls of the casing 18 are in a good thermally conductive contact with the evaporator 15. The evaporator 15, together with a ventilator 19, is accommodated in a depression 20 which is arranged in the left half of the base 14, extends from the front to the rear of the base 14, and is surrounded by thermally insulating walls.

As may be clearly distinguished particularly in FIG. 3, the depression 20 has a rectangular cross section, and the evaporator 15 and the casing 18 are so accommodated in the depression 20 that a free space remains around the evaporator 15 and the casing 18. At its upper part, the depression 20 and also the evaporator 15 accommodated therein, is covered with an intermediate floor 21. This floor 21 has been partially removed in FIGS. 1 and 2 in order to show the evaporator 15 located underneath the same, as well as the ventilator 19 and the depression 20. Conduits 22 and 23, respectively, communicate with the two ends of the depression 20 and extend in the upward direction, these conduits 22 and 23, in turn, communicating with air channels 24 and 25 which are arranged in the bottom or in the rear wall of the housing 11 as visible in FIG. 1. A discharge conduit 26 for the water dripping off the evaporator 15 is arranged at the bottom of the depression 20, as particularly seen in FIG. 3.

A thermally insulating wall which runs through the center of the base 14 and partly bounds the depression 20, is formed with two openings 27 and 28 which may be opened or closed by means of deviating flap valves 29, the position of the flap valves 29 being determined by a kinematic linkage which is actuated by a control member 30 in dependence on the operating condition of the cooling apparatus. As specially seen in FIG. 2, the control member 30 is located, when considered in the direction of flow of air indicated by the arrows, downstream of the condenser 16 accommodated in the base 14. A ventilator 31 forces a stream of air through the condenser 16.

More particularly, the ventilator 31 draws air from the exterior of the housing 11 through a circular opening 32 in the front region of the base 14, and forces the air through the condenser 16 as indicated by the broken-line arrows. When the flap valves 29 are closed (as indicated in FIG. 2 in full lines), the air which is blown through the condenser 16 is directly conducted to the enclosed compressor 17 and around the same, the stream of air passing along a partitioning wall 33 and being discharged into the ambient atmosphere through a rectangular opening 34 in the front side of the base 14 after having cooled not only the condenser 16 but also the compressor 17.

On the other hand, when the flap valves 29 are open (as indicated in FIG. 2 in broken lines) a part of the air stream which has been blown through the condenser 16 by the ventilator 31 is branched off and flows through the opening 27 into the passage which surrounds the evaporator 15 accommodated in the depression in the aforementioned fashion. The branched-off part of the air stream at an elevated temperature flows around the walls which constitute the housing 18 surrounding the evaporator 15, these walls being provided with guiding elements, such as fins, which have not been illustrated but which serve the purpose of guiding the stream of hot air through the passage between the casing 18 and the corresponding depression 20. Afterwards, the stream of air, having accomplished its mission, is discharged from the passage through the opening 28. At this point, the branched-off portion of the air joins with the remainder of the hot air stream, the joint stream then continuing its above-mentioned movement around the compressor 17 and then through the rectangular opening 34 in the base 14 frontwardly to the exterior of the housing 11.

On the other hand, the air which is drawn by the ventilator 19 from the depression 20 after being significantly cooled at the evaporator is blown into the conduit 23 which extends upwardly, and thus into the channel 25 provided in the rear wall of the housing 11. From the channel 25, the cooled air emerges either into the freezer compartment 12 or into the refrigerator compartment 13 and there it cools the goods stored therein. Subsequently thereto, air is withdrawn from the refrigerator compartment 13 through a vertical channel 35 which is also provided in the rear wall of the housing 11, and is then conducted between the bottom of the housing 11 and the intermediate bottom 21 arranged in the base 14 above the evaporator 15, in the frontward direction. Subsequently thereto, this air is conducted through a downwardly extending channel 22 into the evaporator 15, through which it then flows toward the blower 19 so that the circulation of this air can be repeated. Simultaneously therewith, air is withdrawn from the freezer compartment 12 through an air passage 24 which is arranged in the bottom of the housing 11 upwardly of the downwardly extending channel 22. Subsequently thereto, this air from the freezer compartment 12 joins with the air from the refrigerator compartment 13 to pass through the evaporator 15 where the humidity or moisture contained in the air precipitates as frost or ice crystals or layers on the heat-exchange areas of the evaporator 15.

The ventilator 19 which forwards or circulates the cooled air stream is controlled by a conventional thermostat or a similar control device responsive to temperature, such a device not having been illustrated because of its conventionality. Suffice it to say that such a control device is usually arranged in the refrigerator compartment 13 and controls not only operation of the blower 19 but also the enclosed compressor 17 so that both of them operate simultaneously in an intermittent mode of operation. On the other hand, the ventilator 31 which serves the purpose of cooling the condenser 16 and the enclosed compressor 17 preferably works on a permanent basis.

The period defrosting of the evaporator 15 is accomplished in such a manner that the deviating flap valves 29 are moved by means of the control member 30 in their open positions, preferably when the cooling apparatus and simultaneously also the ventilator 19 are out of operation. As already explained before, a partial stream of air which is drawn in by the ventilator 31 and blown through the condenser 16 whereby its temperature content and its heat content are increased, is passed through the opening 27 into the passage provided in the depression 20 around the evaporator 15. As this relatively warm air passes around the evaporator 15 or, more specifically, around the casing 18 which laterally and downwardly surrounds the evaporator 15, this air transmits part of its heat content to the evaporator 15. While the warm air acts only on the marginal portions of the evaporator 15 and on the housing 18, heat conduction through the evaporator 15 will result in increase in temperature of even remote regions of the evaporator 15 so that the frost and ice located or lodged between the fins or lamellae of the evaporator 15 melts. The water which is the product of this melting process is collected at the bottom of the casing 18, and is discharged therefrom by means of a nonillustrated conventional discharge arrangement which is preferably provided with means for preventing passing of air therethrough. The discharged water is conducted to the discharge conduit 26 provided at the bottom of the depression 20 which conducts the water to an evaporating receptacle, which is also not shown because it is conventional, and which is located underneath the condenser 16.

In the currently preferred embodiment of the present invention, provisions are made for blowing the air which has been heated by the condenser 16, as well as the ambient atmosphere which is at a temperature of at least 10° C into the passage around the evaporator 15 in the depression 20 during each period of standstill of the compressor 17. In this manner, the evaporator 15 is defrosted during each of such standstills. It is a necessary result of the proportion of the running time to the standstill time of the compressor 17 that the defrosting process takes longer when the ambient temperature is relatively low. However, inasmuch as the periods of standstill of the compressor 17 are increased during operation at low ambient atmosphere temperature, particularly because of the reduced heat loss through the walls of the housing 11, it is assured that the evaporator 15 will be always faultlessly defrosted regardless of the ambient atmosphere temperature.

This is particularly true when the mass of the evaporator 15 is kept to a minimum within a reasonable boundary so that the cooling capacity of the evaporator 15 is relatively low and thus the defrosting period is relatively short.

As already mentioned above, the control member 30 may be actuated in response to various operating parameters of the cooling apparatus, so that the position of the deviating flap valves 29 can be similarly controlled. So, for instance, the controlling parameter may be the exposed surface temperature of the condenser 16. If such is the case, it is necessary to form the control member 30 as a thermostat the sensing device of which is preferably arranged at the inlet of the condenser 16. This thermostat, which is of conventional construction and thus not shown in the drawing, can be so adjusted that the deviating flap valves 29 are closed at a temperature exceeding 60° C, which exposed surface temperature occurs when the compressor 17 is in operation. On the other hand, when the temperature drops between 40° C which, except for a short transition period, gives an indication of standstill of the cooling apparatus and of the ventilator 19, the flap valves 29 are open.

On the other hand, it is also possible to actuate the control member 30 and thus the deviating flap valves 29 in response to the compression pressure of the compressor 17. Here, again, a completely conventional and thus nonillustrated arrangement may be provided, this arrangement including a control member 30 provided with an expansible receptacle, such as a diaphragm receptacle, the member 30 being connected to the pressure side of the compressor 17 by means of tubes or pipes.

It will be understood that each of the elements described above, or two or more together, may also find a useful application in other types of constructions differing from the type described above.

While the invention has been illustrated and described as embodied in a combined refrigerator-freezer, respectively, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of operating a refrigerator having a compartment to be cooled, and an evaporator, said method comprising the steps of: circulating air in a closed cooling stream through said compartment and over one side of said evaporator; periodically circulating air at a temperature above 10° C in a defrosting stream over the other side of said evaporator; and separating said streams at all times and preventing air from said cooling stream from mixing with air from said defrosting stream.

2. The method defined in claim 1, further comprising the step of passing said defrosting stream over a condenser of said refrigerator before passing same over said other side of said evaporator.

3. The method defined in claim 2, further comprising the step of normally only passing said defrosting stream over said condenser, said defrosting stream being deflected to pass over said other side of said evaporator.

4. The method defined in claim 3, wherein said cooling stream is passed through said evaporator and said defrosting stream is passed around said evaporator.

5. A refrigerating device comprising: a housing having at least one storage compartment; a cooling apparatus having a low-temperature zone including at least one evaporator and a high-temperature zone including a condenser and a compressor; cooling means for circulating a cooling stream of air through said compartment and over said evaporator; defrosting means for circulating a defrosting stream of air through said high-temperature zone and over said evaporator; and means including at least one partition for separating said streams and completely preventing air from one stream from mixing with air from the other stream.

6. The refrigerating device defined in claim 5 wherein said evaporator has a pair of sides, said means for circulating said cooling stream being on one of said sides and said means for circulating said defrosting stream being on the other side.

7. The refrigerating device defined in claim 6 wherein said evaporator is provided with a coil in a heat-conducting casing constituting said partition, said one side being the interior of said casing and said other side being the exterior of said casing.

8. A device as defined in claim 5, wherein said housing further includes a base; and wherein said cooling apparatus is accommodated in said base.

9. A device as defined in claim 5, wherein said circulating means each include means for advancing the respective streams of air.

10. A device as defined in claim 5, and further comprising a substantially box-shaped casing surrounding said evaporator and in a good thermally conductive contact therewith; and wherein said casing constitutes said partition and separates a passage for said cooling stream of air from a defrosting passage for said additional stream of air.

11. A device as defined in claim 10, and further comprising means for bounding said additional passage arranged at the outer circumference of said casing.

12. A device as defined in claim 10, wherein said casing is of a material having high thermal conductivity.

13. A device as defined in claim 5, wherein said defrosting means includes deflecting flap valves displaceable between a closed position for circulation of said defrosting stream only in said high-temperature zone and an open position for circulation of said defrosting stream through said high-temperature zone and over said evaporator.

14. A device as defined in claim 13, and further including means for controlling said flap valves in dependence on the operating conditions of said cooling apparatus.

15. A device as defined in claim 13, wherein said flap valves are thermally insulated so as to prevent undesirable heat exchange between said low temperature and high temperature zones.

16. A device as defined in claim 13, wherein said defrosting means further includes at least one control member; and further including means for actuating said control member in dependence on the temperature of said condenser.

17. A device as defined in claim 13, wherein said defrosting means further includes at least one control member; and further including means for actuating said control member in dependence on the compression pressure of said compressor.

* * * * *